United States Patent [19]

Widén

[11] Patent Number: 4,577,479

[45] Date of Patent: Mar. 25, 1986

[54] CYLINDER LOCK ARRANGEMENT FOR PREVENTING PICKING

[75] Inventor: Bo Widén, Torshälla, Sweden

[73] Assignee: GKN-Stenman AB, Eskilstuna, Sweden

[21] Appl. No.: 727,626

[22] Filed: Apr. 30, 1985

Related U.S. Application Data

[63] Continuation of Ser. No. 435,202, Oct. 19, 1982, abandoned.

[30] Foreign Application Priority Data

Nov. 2, 1981 [SE] Sweden ..... 8106467

[51] Int. Cl.[4] ..... E05B 15/14; E05B 35/10; E05B 27/04

[52] U.S. Cl. ..... 70/364 A; 70/378; 70/419

[58] Field of Search ..... 70/378, 392, 364 A, 70/416, 419

[56] References Cited

U.S. PATENT DOCUMENTS

| | | | |
|---|---|---|---|
| 1,593,513 | 7/1926 | Stone | 70/364 A |
| 2,111,098 | 3/1938 | Segal | 70/364 A |
| 2,202,329 | 5/1940 | Braune | 70/364 A |
| 2,283,489 | 5/1942 | Crousore | 70/364 A |
| 2,596,720 | 5/1952 | Pastor | 70/364 A |
| 2,629,249 | 2/1953 | Mendelsohn | 70/364 A |
| 3,943,739 | 3/1976 | Genakis | 70/364 A |
| 4,078,406 | 3/1978 | Genakis | 70/364 A |

*Primary Examiner*—Robert L. Wolfe

*Attorney, Agent, or Firm*—Sughrue, Mion, Zinn, Macpeak and Seas

[57] ABSTRACT

A cylinder lock has a plug (2) provided with coaxial pin passages (6, 8) arranged to accommodate lock pins (7, 9). At least one pin (9) has a necked portion (9*a*) and a head (9*b*), and at least one of the pin passages (6) exhibits a widened portion (6*a*). The pin head (9*b*) has a smaller diameter than the major part of the pin, and the widened portion (6*a*) of the recess has a smaller radius in a direction transversely of the axis of plug (2) than half the pin diameter. One or more disc-like pin members (11) may be provided between upper and lower pins (9, 7), these disc-like pin members being prevented from entering the widened portion of the recess when activating the lock with the correct key. The arrangement is such, however, that the head (9*b*) is readily hooked-up when an attempt to pick the lock is made.

3 Claims, 9 Drawing Figures

CYLINDER LOCK ARRANGEMENT FOR PREVENTING PICKING

This application is a continuation of application Ser. No. 435,202, filed Oct. 19, 1982 and now abandoned.

BACKGROUND OF THE INVENTION

The present invention relates to an arrangement in cylinder locks of the kind which comprise a plug or cylinder which can be rotated relative to a housing embracing said plug, when the correct key is inserted, which plug and which housing are provided with pin-receiving passages which are coaxial in one position of the plug and which receive pairs of mutually abutting pins, optionally having intermediate disc-like pin members, of which pins at least one of each pair of pins is spring biased towards the others, and the abutment surfaces of which pins when the correct key is inserted are located in the intersurface or dividing plane between the plug and the plug housing.

A person attempting to pick a cylinder lock of this kind can, for example, with the aid of a steel wire or like instrument, push up the pins, one after the other, in the plug to a position in said dividing plane between the plug and plug housing, said pins hereinafter being referred to as "underpins". When the plug is then turned slightly, the corresponding pin located in the housing catches on the cylindrical surface of the core, this pin being referred to hereinafter as the "upper pin". This pin has thus been forced or picked. The operation is then continued in a corresponding manner for each of the subsequent pins in the lock arrangement.

The upper pin can be lifted up and caught, as a result of the necessary clearance between the cylinder plug and the pins. When a pin is lifted up and caught, the pin passages are no longer co-axial.

The U.S. Pat. No. 1,593,513 (Stone) proposes that the mutually facing end surfaces of the upper and lower pins be given a frusto-conical configuration, in order to make picking of a cylinder lock in this way difficult.

The U.S. Pat. No. 2,111,098 (Segal) describes a development of this proposal. In the cylinder lock described in this Patent Specification, one or more of the plug-housing pins is provided in the region of its end facing the plug with a portion of smaller diameter than the remainder of the pin, this portion forming a neck between the major part of the pin and a head formed on the end thereof. The plug is also embraced by a sleeve of smaller wall thickness than the length of the neck portion, and is provided with a plurality of recesses or notches corresponding to the number of necked pins, these notches or recesses including a part which is co-axial with respective pin passages and one or more side portions of smaller dimensions.

Picking of such a cylinder lock is made difficult, because rotation of the plug for the purpose of hooking-up an upper pin can be effected with the use of said recessed sleeve, even when the limit surface between upper and lower pins is not located in the dividing plane between the plug and the housing. Consequently, anyone attempting to pick such a lock will wrongly assume that the first pin has been lifted up and caught, and will then continue with the subsequent pins, although the upper pin, however, is firmly held by the sleeve in a locking position in the plug. Consequently, anyone wishing to pick the lock must begin again with the first pin.

A particular advantage afforded by the arrangement described in said Patent Specification, is that the pin is firmly locked with the necked part inserted in a side part of the recess, so that the pin is unable to move upwardly or downwardly in the pin passage. Consequently, the plug is held locked relative to the housing, to prevent further turning of the plug, which is a prerequisite for preventing picking of the subsequent pins.

Although such an arrangement undoubtedly contributes to making the picking of such a lock difficult, it has the disadvantage that the metal sleeve embracing the plug increases the cost of the lock quite considerably, since in order to function reliably the sleeve must be made with great accuracy, and since the sleeve must also be mounted on the plug with great accuracy and precision.

The U.S. Pat. No. 2,283,489 (Crousore) illustrates another arrangement of the kind in question, in which a pin passage provided in the plug in line with a headed pin at a distance from the mouth of the passage, which mouth is smaller than the axial length of the necked part of the pin, exhibits a widened part which is bordered on one side by an edge of the mouth of a passage and which, subsequent to rotating the plug, is able to overlap a part of the pin head, to hook the pin in a locking position. The widened part is of eccentric shape, with its largest extension transverse of the plug axis.

Although this arrangement can be considered to render picking of the lock difficult, it has, among other things, the disadvantage that the lock cannot be used in a system lock of the kind in which intermediate, disc-like pin members are located between headed pins. Restrictions are particularly evident with respect to the thickness of the disc-like pin members. Consequently, it is impossible in practice to use thin disc-like pin members.

A corresponding disadvantage is found in the arrangement described in the U.S. Pat. No. 2,202,329 (Braune), in which arrangement the plug is provided with a longitudinally extending, rectilinear groove in the vicinity of the mouths of the pin passages. It is also impossible to use this kind of cylinder lock in system locks provided with disc-like pin members, since the pin members would slide uncontrollably in said groove.

The U.S. Pat. No. 3,762,193 (Hucknall) describe a different arrangement, in which the pins are not necked and headed, but which use instead conical disc-like pin members arranged to co-act with a constriction in the pin passages, to render picking of the lock difficult.

SUMMARY OF THE INVENTION

The object of the present invention is to provide an arrangement of the aforedescribed kind which renders the picking of system locks extremely difficult, even such locks as those provided with disc-like pin members, and which avoids the disadvantages of previously known arrangements.

An arrangement according to the invention is characterized in that the head of the pin has a smaller diameter than the major part of said pin, and that the radius of the widened part of the eccentric recess transversely of the axis of the core or the core housing is less than half the pin diameter.

In an arrangement according to the invention, picking of the lock is made difficult by the fact that the headed pin portion, where the diameter of the head is smaller than the diameter of the pin, can readily be hooked at any location in the eccentrically shaped widened portion of the pin passage when an attempt is made to pick the lock. At the same time, it is ensured in system locks of the kind where one or more pin passages accommodate, in addition to pins, disc-like pin members that the disc-like pin members are guided so as to be unable to cause unintentional hooking of the pins when the lock is used normally.

A preferred embodiment in which a disc-like pin member is located between upper and lower pins is characterized in that the axial height of the widened recess portion exceeds the thickness of the disc-like pin member.

In an embodiment preferred in practice, the pin passage has a radius of approximately 1.5 mm, and its widened portion has a height of 0.5–1.5 mm, preferably about 1 mm, a transverse radius of about 1.3 mm and is located 0.3–1.1 mm, preferably about 0.7 mm from the mouth of the pin passage.

The widened part of the pin passage can either be located in the plug or in the plug housing, and optionally in both the plug and the housing. In this latter case, further difficulties are presented to anyone trying to pick the lock, with a corresponding increase in the total proof of the lock against being picked.

Widening of the pin passage can, for example, be effected with the use of any suitable tool which, in accordance with a preferred embodiment, ensures that the widened portions of the pin passage or passages in question obtain an eccentric configuration, with the largest dimension being transversely of the plug axis.

This embodiment enables two mutually adjacent pin passages to be provided with widened portions without risk of the core portion or housing portion located between said two passages being too thin.

Suitable measurement ranges for the design and position of the widened portion of the pin passages have been given in the aforegoing. These measurements apply to cylinder locks of standard size and design. Other measurements may be applicable in the case of cylinder locks of particularly small or large dimensions intended for special purposes.

BRIEF DESCRIPTION OF THE DRAWINGS

Further characterizing features of the arrangement according to the invention and advantages afforded thereby will be apparent from the following description, which is made with reference to a preferred embodiment thereof. The invention will be described with reference to the accompanying schematic FIGS. 1, 2, 4, 5, 7 and 9, while the remaining Figures, i.e.

FIG. 3 is a sectional view corresponding to FIG. 2 and illustrating how, when an attempt is made to pick the lock, the disc-like pin member fastens in the widened recess of the pin passage if the radius of the recess is too large, i.e. corresponding to known methods.

FIG. 6 is a view taken at right angles to the view shown in FIG. 5, i.e. in the longitudinal direction of the plug, and a disc-like pin member located in the widened portion of the recess, in accordance with known designs.

FIG. 8 is a sectional view of an arrangement in which the widened portion of the pin passage is instead located in the plug housing, and where a disc-like pin member has fastened in an excessively large recess, in accordance with known designs.

DETAILED DESCRIPTION OF THE PREFERRED EMBODIMENTS

Figure 1:
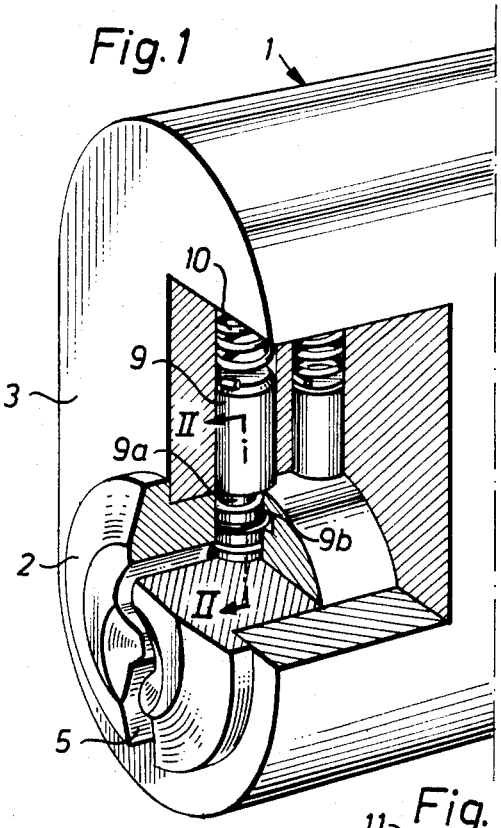
FIG. 1 is a partially cut-away perspective view of a cylinder lock provided with a plug and plug housing, two mutually co-acting pairs of locking pins being at least partially shown, of which one pair of pins is provided with an arrangement according to the invention.
Figure 2:
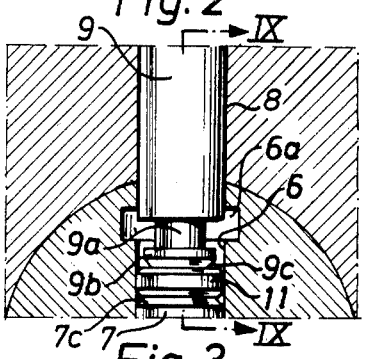
FIG. 2 is a vertical, partially sectional view taken at right angles to the plug axis through a cylinder lock according to FIG. 1, a disc-like pin member being provided between the illustrated upper and lower pin.

Referring primarily to FIGS. 1, 2, 4, 5, 7 and 9, there is illustrated a cylinder lock 1 comprising a plug 2 which is embraced by a housing 3 and which can be rotated in said housing when the correct key (not shown) is inserted into the lock. The key slot is referenced 5. Arranged in the plug are passages 6 for receiving lower and upper pins 7 and 9 respectively.

The housing 3 is provided with corresponding, coaxial pin passages 8, in which the upper pins 9, biassed by a spring 10, are located. The end of the illustrated upper pin 9 facing the lower pin 7 with which it co-acts is provided with a necked portion **9*a*, which merges with a widened head 9*b*, the diameter of which is smaller than the main part of the pin. The head 9*b* of the pin 9 is provided at its lower end with a chamfer 9*c*. Located between the upper and lower pins is a disc-like pin member 11**.

Figure 5:
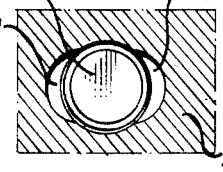
FIG. 5 is a sectional view taken on the line V—V in FIG. 4, and illustrates the pin passage with a widened portion of eccentric shape, a disc-like pin member being located in the center of said widened portion.

The pin passage 6 is provided at a distance from its mouth at the peripheral surface of the plug 2 with a widened portion **6*a*, the height of which may be about 1 mm and which in other respects—as illustrated in FIG. 5—has an eccentric shape with its largest extension transversely of the plug axis. If the pin passage has a diameter of 3 mm, the widened portion 6*a* may have a radius in the transverse direction of about 1.3 mm, and its upper limit surface may be located at a distance of about 0.7 mm from the mouth of the pin passage. This distance of 0.7 mm is slightly shorter than the axial length of the necked portion 9*a* of the upper pin 9, the length of which necked portion thus reaches to about 1 mm, i.e. is greater than the height of the mouth edge or lip 2*a***.

Figure 3:
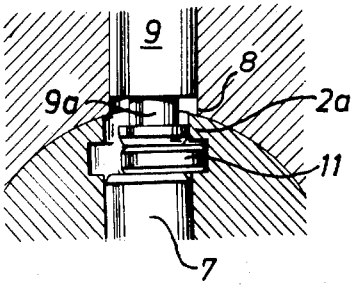
Fig. 3 PRIOR ART
FIGS. 3, 6 and 8, illustrate other embodiments with which it is not possible to obtain all of the advantages afforded by the invention.
Figure 4:
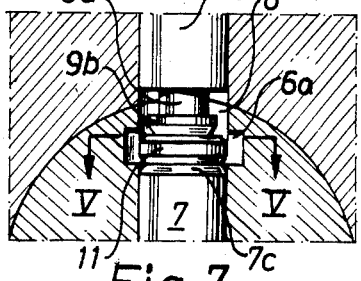
FIG. 4 is a sectional view corresponding to FIG. 2 and illustrating how, when the lock is activated with the correct key, the disc-like pin member does not move into the widened portion of the recess, but is guided centrally in the pin passage, in the form of recess according to the invention.
Figure 6:
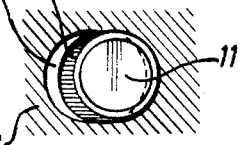
Fig. 6 PRIOR ART

FIG. 5 illustrates the aforegiven measurement relationships, i.e. shows that the radius of the widened portion of the eccentric recess **6*a* transversely of the plug axis is less than half the pin diameter. This enables the disc-like pin member 11 located between the upper and lower pins 9 and 7 respectively to be accurately guided, so that when the lock is activated by the correct key the disc-like pin member is unable to enter the widened portion 6***a* of the recess. When the recess radius is too large, as with the known design illustrated in FIGS. 3 and 6, the disc-like pin member is able, in the transverse direction of the plug, to enter the eccentrically widened portion 6*a*, if the height of the recess 6*a* is greater than the thickness of the disc-like pin member, as illustrated in FIG. 3.

When an attempt is made to force the lock, there is always a risk of the head 9*b* of the upper pin becoming fastened due to the head entering the widened portion 6*a*, while the lip 2*a* formed in the region of the periphery of the plug engages the necked portion 9*a* of the upper pin. This is illustrated in FIG. 7, where the widened portion 6*a* of the pin passage also has a greater height axially.

Figure 7:
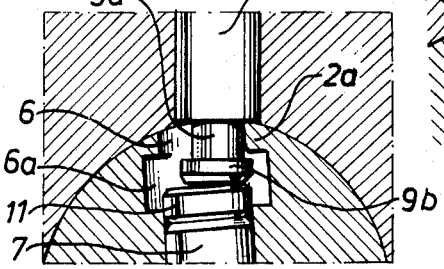
FIG. 7 is a sectional view corresponding to FIG. 3, where the plug has been turned some degrees in an attempt to pick the lock.

The combination of the necked portion 9*a* and the head 9*b* of the upper pin makes it practically impossible to determine when the abutment surface is located in the correct dividing plane, and rotation using the available clearance, which must always be undertaken in order to attempt to hook-up the upper pin, practically always results in the head being hooked fast by the plug lip 2*a* which partially overlaps said head, in the manner illustrated in FIG. 7.

FIG. 7 illustrates the maximum extent to which the plug can be rotated in fixing the upper pin 9. The upper pin, however, will hook fast in the widened portion 6*a* of the passage when the plug is rotated to a far less extent.

Figure 8:
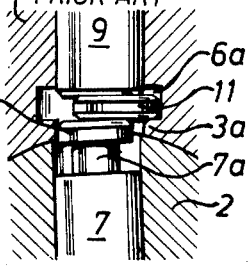
Fig. 8 PRIOR ART

FIG. 8 illustrates a pin 9 located in the housing 3, the housing being provided with a widened portion 6*a* which is defined at the bottom by a mouth edge 3*a*. The lower pin 7 is also provided with a necked portion 7*a* and a head 7*b* having a conical portion 7*c*. FIG. 8 illustrates how the intermediate disc-like pin member 11 is liable to enter the widened portion 8*a* of the pin passage 8 when an attempt is made to pick the lock, if the radius is too large, as with known designs.

Figure 9:
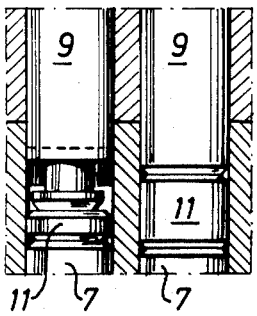
FIG. 9, finally, is a sectional view taken through two pin passages and associated pins and intermediate disc-like pin members, one pin passage accommodating a disc-like pin member of greater thickness than the height of the widened pin passage, hidden from view by the disc-like pin member.

FIG. 9 illustrates two mutually adjacent pairs of pins of a cylinder lock according to FIG. 1, provided with an arrangement according to the invention. Each of the pin passages accommodates a disc-like pin member, of which the one shown to the right has a greater thickness or height than that shown to the left. In the illustrated embodiment, both pin passages are assumed to be provided with widened portions. Irrespective of whether this is so or not, either one or both pins of corresponding pin pairs may have a necked portion 7*a* and a head 7*b*.

I claim:

1. A master set type of cylinder lock, comprising: a cylindrical plug (2) rotatably mounted in a plug housing (3), said plug being rotatable in said housing when a correct key is inserted in said plug, and said housing closely surrounding said plug without any significant gaps therebetween, a plurality of transverse pin passages (6, 8) respectively defined in said plug and housing, said passages being axially aligned during key insertion, a plurality of transversely slidable, rotatable pin pairs (7, 9) disposed in said passages, one pin in each pair being spring biased (10) in a direction towards the other pin, and abutment surfaces of said pin pairs, when the correct key is inserted, being located in a dividing plane between the plug and the housing, at least one pin (9), at an end thereof facing an opposite, co-acting pin, having a portion of smaller diameter than the remainder thereof, said portion forming a necked region (9*a*) between a main part of said at least one pin and a generally cylindrical head (9*b*) on the end of said at least one pin, a passage for said at least one pin defining a pair of diametrically opposed, laterally extending recesses (6*a*) in line with said at least one pin at a distance from a mouth of the passage shorter than the axial length of the necked region of said at least one pin and having widened portions defined on one side by an edge (2*a*) of the mouth of the passage, said edge, upon the rotation of the plug through a small angle, being able to overlap the head of said at least one pin and hook-latch said at least one pin in a locked position, said widened portions having an eccentric shape with a largest dimension transverse to a longitudinal axis of the plug, at least one disc-like pin member (11) of the same diameter as said pin pairs disposed between said at least one pin and its coacting pin, the head of said at least one pin having a smaller diameter than the main part thereof; and the radii of the widened portions of the recesses transverse to the plug axis being less than half the diameter of said at least one pin, whereby the smaller diameter pin head may enter the recesses but the disc-like pin member may not.

2. A cylinder lock according to claim 1, wherein the axial height of the recesses is greater than the thickness of the disc-like pin member, but the disc-like pin member is prevented from entering the widened portions of the passage by the smaller radii of the widened portions.

3. A cylinder lock according to claim 1, wherein each pin passage has a radius of about 1.5 mm, and the widened portions of the recess have a height of 0.5–1.5 mm, preferably about 1 mm, a radius in the transverse direction of about 1.3 mm, and are located 0.3–1.1 mm, preferably about 0.7 mm from the mouth of the pin passage.

* * * * *